United States Patent [19]

Podosek

[11] Patent Number: 4,519,629

[45] Date of Patent: May 28, 1985

[54] SPIRAL BOUND NOTEBOOK AND FOLDER CONSTRUCTION

[75] Inventor: Edward Podosek, Wilbraham, Mass.

[73] Assignee: Dennison National Company, Holyoke, Mass.

[21] Appl. No.: 498,533

[22] Filed: May 26, 1983

[51] Int. Cl.[3] ..... B42D 1/04; B42D 3/18; B42C 7/00

[52] U.S. Cl. ..... 281/25 A; 281/31; 412/3

[58] Field of Search ..... 281/25 A, 31; 412/3, 412/4; 493/243, 181, 156

[56] References Cited

U.S. PATENT DOCUMENTS

| | | | |
|---|---|---|---|
| 1,440,936 | 1/1923 | Shepard | 281/31 |
| 3,680,969 | 8/1972 | Gorman | 281/31 |
| 4,420,112 | 12/1983 | Cline | 281/31 |

FOREIGN PATENT DOCUMENTS

| | | | |
|---|---|---|---|
| 0050592 | 4/1982 | European Pat. Off. | 281/31 |

*Primary Examiner*—Paul A. Bell

*Assistant Examiner*—Paul M. Heyrana, Sr.

*Attorney, Agent, or Firm*—Chapin, Neal & Dempsey

[57] ABSTRACT

Improved spiral bound notebook and folder construction is disclosed which is formed from an integral blank of flexible sheet material. The folder includes a pair of hingedly interconnected opposed cover panels, a pocket-forming panel hingedly connected along an edge of one of the cover panels and a closure flap hingedly extending from the outer edge of the other cover panel. The pocket forming panel includes one edge portion which is adapted to be folded in superposed relation along one side of the hinge line which interconnects the two cover panels. The folder also includes another flap portion which overlays the other side of the hinge line. The folder is punched to provide wire holes on opposite sides of said hinge line through the cover panels, superposed edge portion of the pocket forming panel and the other flap portion of the folder. A continuous wire is helically wound through the wire holes in the folder and through corresponding wire holes or perforations disposed along the inner edge of a pad of loose leaf notebook paper.

2 Claims, 4 Drawing Figures

SPIRAL BOUND NOTEBOOK AND FOLDER CONSTRUCTION

BACKGROUND OF THE INVENTION

Wire bound or spiral bound notebooks have been on the market for many years. Conventionally, the wire bound notebook includes a pair of separate cover members which include wire receiving holes or perforations along their inner edges and along the inner edges of loose leaf sheets bound into the notebook. The wire is wound helically through the registered perforations of the discrete cover members and those of the pad of paper.

The present invention relates to wire bound notebook products and their method of manufacture and particularly to improvements therein which constitute a significant departure from the typical spiral bound notebook with respect to several aspects of their construction. Firstly, the product constitutes a combination file folder with storage pocket and notebook. Secondly, the cover is formed from a unitary die-cut sheet material which may be a relatively light weight, flexible stock and not the heavier cardboard stock usually employed in such notebook covers. Thirdly, the cover sheet is scored or creased and perforated in such a manner that a reinforced multi-ply hinge construction is achieved.

The principal object of this invention is to provide a spiral bound notebook having a multiply sheet material along the spiral bound hinge area of the product.

Another object of this invention is to provide a notebook of the above type which is formed from a creased and folded unitary cover sheet material.

A further object of this invention is to provide a notebook of the above type which includes an inner storage pocket and an outer closure flap.

Yet another object of this invention is to provide an improved method of manufacturing a spiral bound notebook of the above type.

The above and other objects and advantages of this invention will be more readily apparent from the following description read in conjunction with the accompanying drawings, in which.

Figure 1:
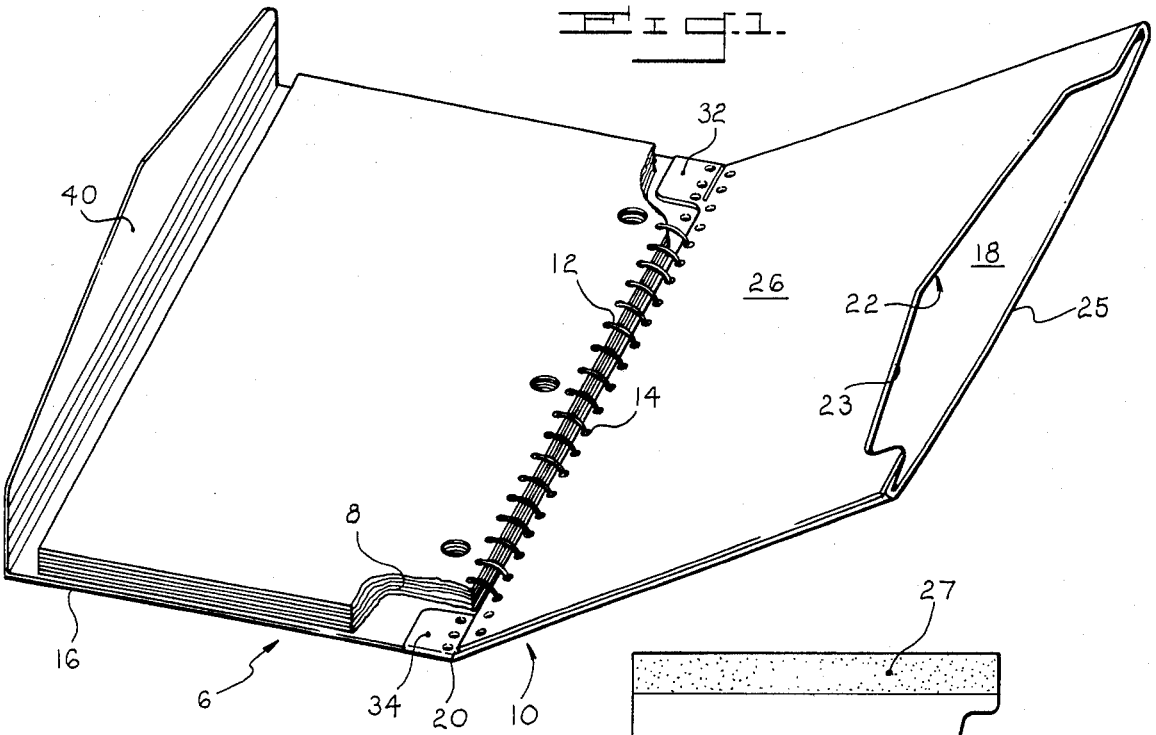
FIG. 1 is a perspective view of a spiral bound notebook of the type embodying this invention.

Referring in detail to the drawings in FIG. 1, a combination file folder and notebook is shown generally at 6. The notebook includes a pad of loose leaf paper 8 bound to hinged cover member 10 by means of a wire 12 helically wound through a plurality of closely spaced wire holes or perforation in the sheets which make up pad 8 and similar wire holes or perforation 14 through the cover member 10.

The cover member 10 includes a pair of cover panels 16 and 18 defined at their inner edges by a hinge 20 which may be a score line or crease which runs from end-to-end of in the sheet material which makes up the cover 10.

For ease of explanation, the cover panel 18 will be considered the front cover and cover panel 16 will be considered the back cover of the notebook. A pocket 22 is provided on the inner surface of the front cover panel 18. The pocket 22 which opens outwardly toward the outer edge 25 of the cover flap includes an obtuse, V-shaped outer edge 23. The pocket is formed by a panel 26 of approximately the same size as cover panel 18, except for the V-shaped edge, and it is hingedly connected at 28 along one side edge of cover panel 18. Pocket 22 is thus defined by the opposed inner surfaces of panels 18 and 26 as will be apparent by reference to FIGS. 1 and 2. To the outer edge portion of a panel 26, a surface coating of a suitable adhesive 27 is applied for bonding the edge of flap 26 to a small glue flap 30. Flap 30 is hinged along crease line 32 to the side edge of panel 18 opposite edge 28.

Figure 4:
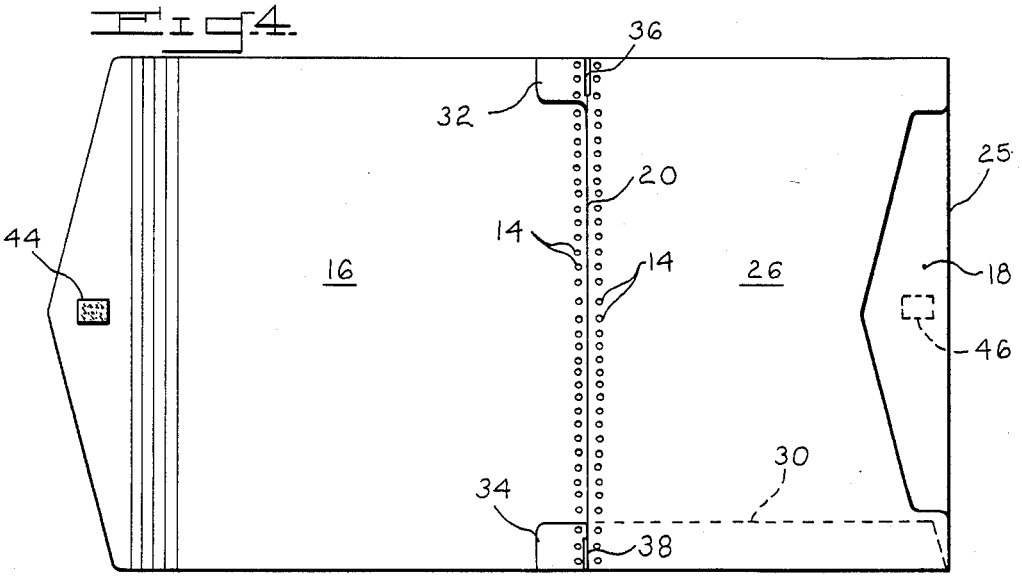
FIG. 4 is a view showing the blank of FIG. 2 in its completely folded and perforated condition ready to receive a helical binding wire.

Reinforcing tabs 32 and 34 respectively, extend from the inner edge portion of panel 26 and from flap 30 laterally to form extensions along outer ends of hinge line 20. Both flaps are hinged to opposite side edge portions of panel 16 by extensions of crease lines 28 and 32. Narrow slots or slits 36 and 38, which extend longitudinally of the hinge line 20, facilitate the folding of the blank along hinge line 20 when forming the notebook, as shown in FIG. 4, and ensures free and easy hinge action of the cover along crease line 20. The crease line 20 thus extends the full length of cover panels and includes slits 36 and 38 provided along one hinge line portion of the flaps 32 and 34.

The back cover panel 16 has approximately the same dimensions as panel 18, except for a closure flap 40 of triangular configuration which extends from the outer edge of panel 16 and is connected thereto by a plurality of parallel crease or fold lines 42. These hinge lines enable the flap 40 to be swung closed over notebook contents of varying thickness. The inner surface of flap 40 may be provided with a velcro fastener strip 44 for fastening engagement with a cooperative strip 46 on the outer surface of panel 18 disposed adjacent to the outer edge thereof.

Figure 2:
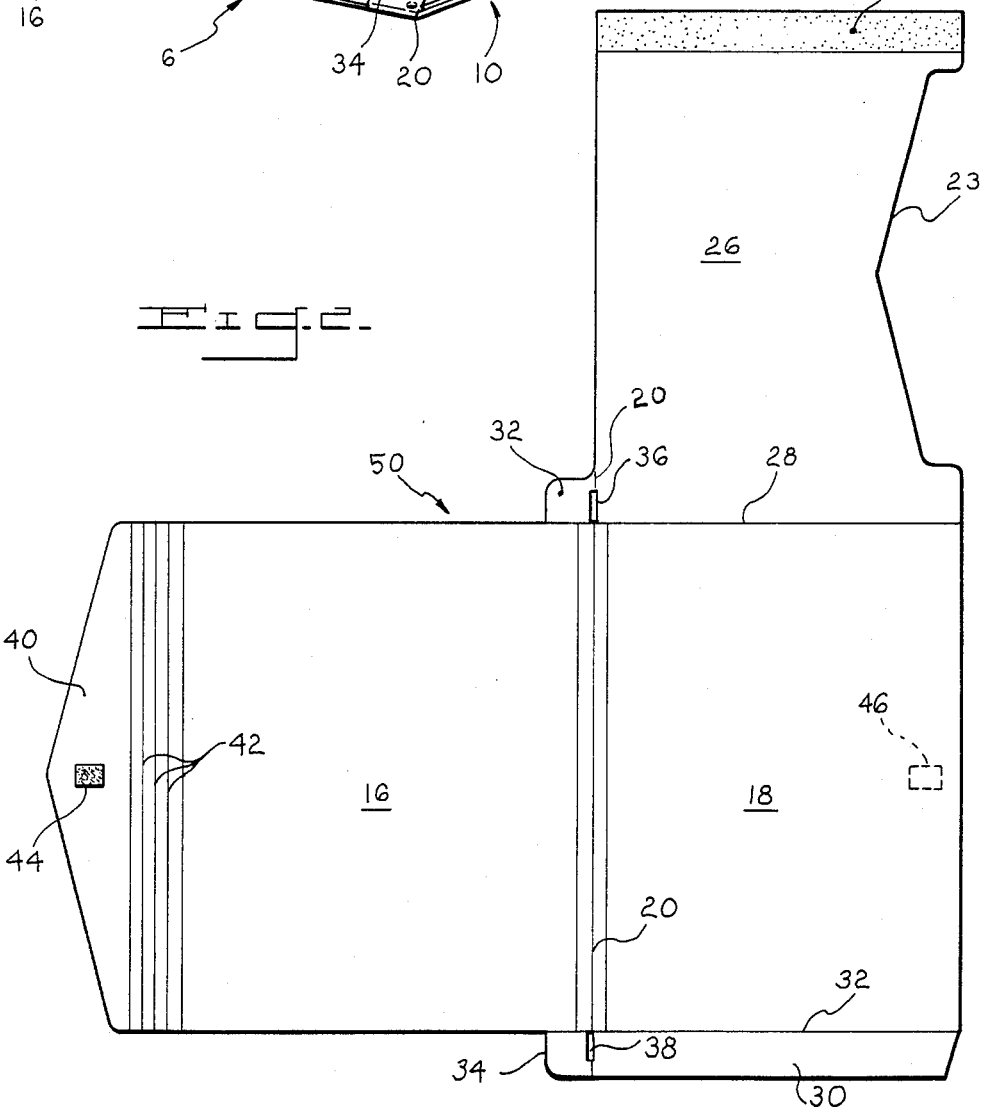
FIG. 2 is an overall plan view of a unitary blank used in forming the notebook of FIG. 1.

In the fabrication of a folder and notebook 6 of the type embodying this invention, a unitary blank 50 is die-cut and simultaneously scored or creased as shown in FIG. 2. The blank 50 includes foldable main panels 16, 18 and 26, glue flap 30, hinge line reinforcing flaps 32 and 34 and closure flap 40 as described above. After die-cutting, a coating of adhesive 27 is applied along the outer edge portion of flap 26.

Figure 3:
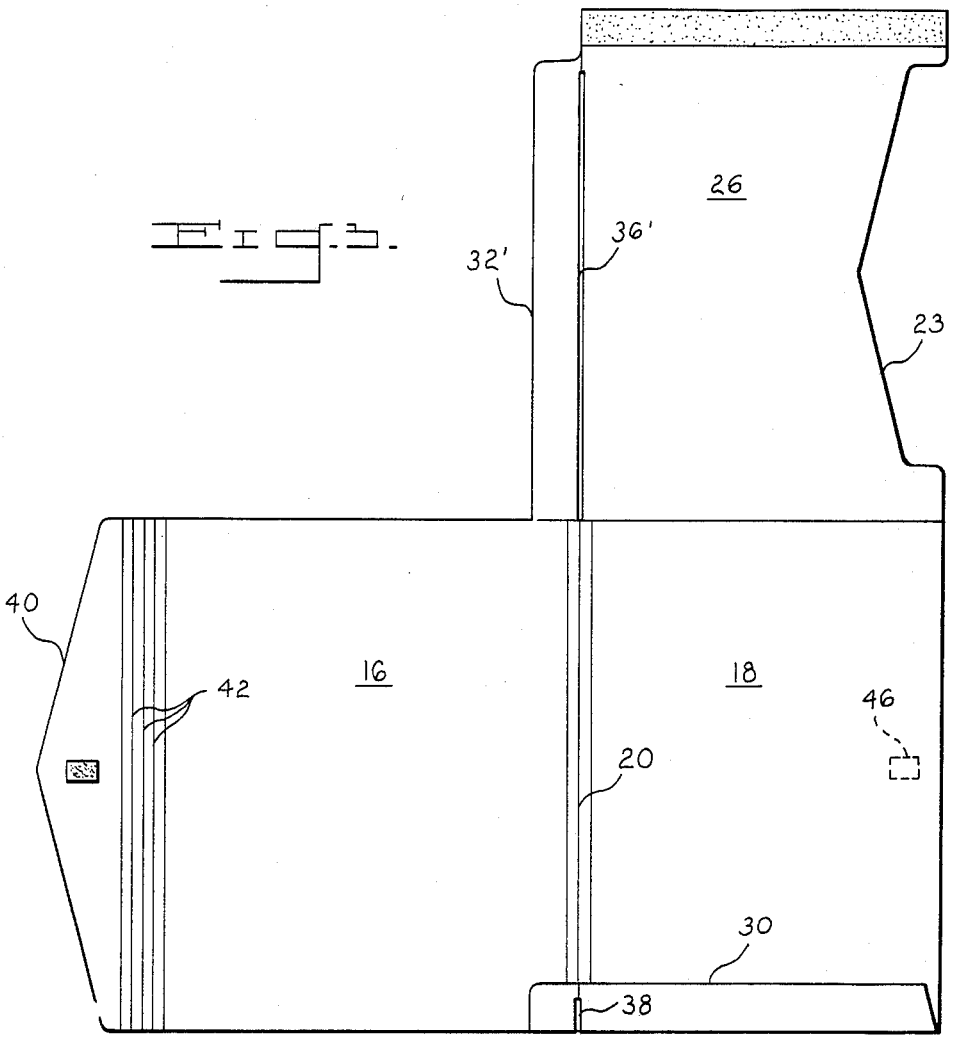
FIG. 3 is a view similar to FIG. 2 showing an alternate embodiment and with the blank in partly folded condition.

Thereafter, the flap 30 is folded upwardly, as shown in FIG. 3 and panel 26 may then be folded downwardly into superposed relation to panel 18 as best shown in FIGS. 3 and 4 and glued to the outer surface of flap 30.

Thereupon, the folded blank may be perforated, that is wire holes 14 are the punched on opposite sides of hinge line 20 as best illustrated in FIG. 4. It will be noted that these holes are punched through the inner superposed edge portions of both panels 26 and 18 on the one hand and of tabs 32 and 34 and the underlying portions of panel 16 on the other hand. The wire holes are thus punched through two discrete layers of sheet material along the entire inner edge portion of the outer cover panel 18 and along the outer end portions of rear cover panel 16. Since these areas of a spiral bound notebook are usually subject to the most wear, their multiply or two layer construction is an important feature of this invention.

While the relatively small reinforcing tabs 32 and 34 have proved acceptable in contributing to the characteristics of this product, it is also within the purview of this invention to employ a reinforcing tab which extends essentially the full length of the panel 26. This alternate construction is illustrated in FIG. 3 and a reinforcing tab of this type is designated 32'. Tab 32' extends from its inner edge fold line to a small hinge line inwardly of the adhesive coated portion of panel 26. A slit 36' extends almost the entire length of the flap 32' and it is adapted to register with crease line 20 when the panel 26 is folded over panels 16 and 18.

After a folded blank is punched, as shown in FIG. 4, a wire 12 is wound in a conventional manner through the wire holes 14 in the cover panels 16 and 18 and the holes of a loose leaf pad 8 to produce a product as the type shown in FIG. 1.

The notebook and folder combination embodying this invention, as illustrated in FIG. 1, is simple and economical to manufacture and is remarkably durable, even though formed of relatively lightweight sheet stock. In addition, this product is most versatile since it has a convenient pocket for holding a variety of loose papers and the like. Moreover, the closure flap 40 enables the folder to be closed to ensure the secure retention of the folder contents.

Having thus described this invention, what is claimed is:

1. Spiral bound notebook comprising a cover formed of a blank of unitary sheet material having a front cover panel and a back cover panel, said cover panels being interconnected at their inner edges by a hinge line, at least one other panel pivotable about a fold line normal to said hinge line into superposed relation over a portion of at least one of said cover panels which is adjacent said hinge, means for securing the edge of said other panel opposite its fold line, a series of closely spaced perforations being formed in alignment along each side of said hinge, a binder wire disposed in helical configuration in said perforations, at least some of said perforations extending through the superposed portion of said one cover panel and said other panel to form a storage pocket in said notebook, the helical wire defining the inner portion of said pocket and adapted to bind a perforated pad of paper within said notebook.

2. Spiral bound notebook as set forth in claim 1, in the edge securing means includes a glue flap disposed along the edge of said one cover panel opposite said fold line, a first hinge reinforcing tab extending from the inner edge portion of said foldable panel and a second hinge reinforcing tab extending from the inner edge portion of said glue flap, said reinforcing tabs being foldable over the outer end portions of said hinge, said perforations being formed in registration through said reinforcing tabs, said cover panels and said other panel, said helical wire being wound through said perforations whereby multi-ply sheet material is provided on each side of said crease line adjacent the outer ends thereof.

* * * * *